US011149212B2

(12) United States Patent
Montilla et al.

(10) Patent No.: US 11,149,212 B2
(45) Date of Patent: Oct. 19, 2021

(54) RECOVERY AND UPGRADE PROCESS OF OIL BASES FROM USED OILS

(71) Applicant: Phoenix RRS, Panama (PA)

(72) Inventors: Froilan José Aguirre Montilla, Estado Aragua (VE); Adolfo Javier Lander Padrino, Estado Aragua (VE)

(73) Assignee: Phoenix RRS, Panama (PA)

( * ) Notice: Subject to any disclaimer, the term of this patent is extended or adjusted under 35 U.S.C. 154(b) by 139 days.

(21) Appl. No.: 16/568,147

(22) Filed: Sep. 11, 2019

(65) Prior Publication Data

US 2021/0071095 A1 Mar. 11, 2021

(51) Int. Cl.
*C10G 53/14* (2006.01)

(52) U.S. Cl.
CPC ..... *C10G 53/14* (2013.01); *C10G 2300/1007* (2013.01); *C10G 2300/208* (2013.01)

(58) Field of Classification Search
None
See application file for complete search history.

(56) References Cited

U.S. PATENT DOCUMENTS 4,360,420 A * 11/1982 Fletcher ..... C10G 21/16 208/184
4,512,878 A * 4/1985 Reid ..... C10M 175/02 208/179
2009/0223862 A1* 9/2009 MacDonald ..... C10G 7/003 208/184
2014/0251869 A1* 9/2014 MacDonald ..... C07C 7/005 208/88
2016/0053184 A1* 2/2016 Wheeler ..... B01D 3/346 585/241
2020/0407648 A1* 12/2020 Mart Nez Gomez ..... C07C 7/00

* cited by examiner

*Primary Examiner* — Derek N Mueller
(74) *Attorney, Agent, or Firm* — Knobbe, Martens, Olson & Bear, LLP

(57) ABSTRACT

A multi-phase process involves physical and chemical methods to recover the oil bases of used oils. The resulting oil base meets the standards and technical specifications necessary for reuse in the formulation of lube oils, greases and alike. The process includes classifying the used oil according to its physicochemical characteristics in order to optimize the subsequent phases. Next, the used oil is subject to physical pre-treatment to remove the solids of about 20 microns, dehydrate them and extinguish the remains of light hydrocarbons. Afterwards, the used oil undergoes extraction with organic chemical solvents on specific proportions within certain pressure and temperature ranges. The output is an extract composed of the oil base, the solvents and a semi-solid precipitate containing the used oil pollutants. Next, the extract is separated from the precipitate by physical methods. Subsequently, the extract passes through another physical procedure that separates the solvents from the oil base.

18 Claims, No Drawings

RECOVERY AND UPGRADE PROCESS OF OIL BASES FROM USED OILS

BACKGROUND OF THE INVENTION

Field of the Invention

This invention involves the chemical industry of hydrocarbons, specifically the regeneration of oil bases contained in used oils from the automobile, industrial and maritime sectors.

Description of the Related Art

Many processes of oil base recovery have been developed, namely: Acid-Clay, Phillips PROP, Norco Distillation, Norco Distillation and pre-treatment, BERC Solvent Extraction and Distillation, Water Treatment, Propane Clearance, Emulsifier, Caustic Treatment, Alcohol-Aliphatic-Acid Treatment, Aluminum Caustic-Peroxide-Chloride Treatment, BERK, KTI, and Recyclone.

Existing processes of regeneration of used oils by extraction with alcohol-type solvents and ketones (KTI) require the following general phases (prior technology):

1. Extraction with an admixture of solvents of different types, at high ratios, with or without chemical pre-treatment and with heating.
2. Every separation of the extract components (solvents and oil base) is carried out by distillation at atmospheric pressure or distillation at reduced pressure.
3. Oil base refining with adsorbent soil, by catalytic hydro-treatment, by acid treatment, etc.

SUMMARY OF THE INVENTION

Since all these processes are energy-intensive and produce noxious waste, this invention has developed a multi-phase process that considerably reduces energy consumption. The mixing of the used oil with the extraction solvents virtually at room temperature does not form micro-emulsions, whose separation used to require high power consumption. In this way, the distillation in the separation phase of the oil base of the extraction solvents is minimized. Moreover, this method does not require harmful chemical substances, such as acids, bases, surfactants and ketones, controlled in most states because of their use to manufacture illicit substances. This invention achieves high recovery percentage of oil base and a negligible content of aromatic compounds, sulfur and metals, with the latter reaching the level of traces. An asphaltic material of wide use in multiple fields and of high commercial value is also obtained as byproduct.

In this invention, the lubricant oil base found in used oils is separated from the rest of undesirable compounds through a number of phases. The recovered oil base has similar characteristics to the native oil base. When the recovered oil base is formulated and/or mixed with the relevant additives, high-quality lube oil is produced. Specifically, the invention consists of extraction with polar organic, alcohol-type solvents that regenerates the oil base of used oils. The procedure implies the separation of these solvents and the oil base with minimal energy use in comparison with other processes. The procedure also includes a new process of final refining with a filtrate that adsorbs and decreases aromatic chemical compounds and those with high sulfur content. Additionally, this procedure reduces the content of metal to trace levels. All these compounds are not desirable in good-quality oil base and they are responsible for its dark coloration.

Oil bases are both of a natural origin, including paraffinic, naphthenic and aromatic mineral bases, and of a synthetic origin, such as polyalphaolefins (PAO) and esters. The blend of an oil base with chemical additives yields oils and greases. Chemical additives upgrade the physicochemical properties of the oil base or confer them additional properties that are not naturally present.

Following their use in machinery and equipment during the service period recommended by the manufacturer, oils are discarded and replaced. In used oils the oil base molecules undergo small changes or little degradation. Instead, most molecules in the additives degrade and become oil pollutants. In addition to some other chemicals characteristic of wear and tear of the lubricated equipment and the residues of the engine ignition that manage to cross the seals and bearings, such pollutants diminish the oil or make it lose its beneficial properties.

Abstract

This invention is a multi-phase process that involves physical and chemical methods to recover the oil bases of used oils. The resulting oil base meets the standards and technical specifications necessary for reuse in the formulation of lube oils, greases and alike. The process includes the phases: firstly, the used oil is classified according to its physicochemical characteristics in order to optimize the subsequent phases. Next, the used oil is subject to physical pre-treatment to remove the solids of about 20 microns, dehydrate them and extinguish the remains of light hydrocarbons. Afterwards, the used oil undergoes extraction with organic chemical solvents on specific proportions within certain pressure and temperature ranges. The output is an extract composed of the oil base, the organic solvents and a semi-solid precipitate containing the used oil pollutants. Next, the extract is separated from the precipitate by physical methods. Subsequently, the extract passes through another physical procedure that separates the organic solvents from the oil base. Then, the recovered oil base is upgraded by physicochemical means. The viscoelastic and semi-solid precipitate undergoes a series of physicochemical processes to oxidize it and upgrade its properties until turning into an asphaltic product of high commercial value.

Objectives

The main objective of this invention is to recover the oil base in used oils, by separating it from the pollutants present in the mixture.

Secondary Objectives:

1) To recover an oil base of similar or superior quality compared with the native oil base, without the need for a final refining with adsorbent or bleaching bentonites, clays or soils, or by acid treatment or catalytic hydro-treatment.

2) To minimize the use of distillation to separate the oil base from the solvents used in the extraction.

3) To avoid the problems of pollution caused by solid waste, wastewater and gaseous emissions, resulting from the methods currently used in solvent extraction.

Finally, all of the listed objectives are attained under this method without the use of equipment or techniques that require expensive investments and onerous maintenance, such as catalytic hydro-treatment, super-critical extraction, and high-vacuum thin-layer distillation, among others.

DETAILED DESCRIPTION OF THE PREFERRED EMBODIMENT

General Description of Invention

The process begins with the reception of the used oil. The used oil is classified according to its physicochemical characteristics in order to optimize the subsequent phases. The used oil goes through a physical process of elimination of particles of a size close to 20 microns. Such removal can be done by filtration or centrifugation. Next, the used oil is dehydrated and volatile compounds, such as light hydrocarbons, are removed. This is achieved by means of decanting or atmospheric, flash or molecular distillation. The used oil is then subject to extraction with aliphatic solvents within certain pressure and temperature ranges. The choice of pressure and temperature depends on the physicochemical characteristics found in the used oil. The output of the extraction phase is a liquid mixture of solvents and oil base, plus a viscoelastic precipitate composed of some other substances of the used oil. Next, the oil base is separated from the solvents by physical means. The semi-solid precipitate comes under a treatment of physicochemical oxidation to transform it into an asphaltic product and provide the stability and properties necessary for its use in multiple fields. Once separated from the mixture, the oil base enters an upgrade phase, as follows: 1) molecular or flash distillation to remove traces of solvent; 2) fine filtration with a 1 μm sieve to retain micro-particles; 3) treatment through a system that adsorbs and diminishes the polar compounds such as aromatics and the compounds of a high sulfur content, and also reduces the metal content to trace levels, by means of a system that contains a filter and/or a mixer with filter. Again, these compounds are not desirable in good-quality oil base and they are responsible for its dark coloration.

Detailed Description of Invention

The used oil is received and classified according to its physicochemical characteristics, in order to optimize the subsequent phases. It is then subject to a physical process of removal of particles of about 20 microns in size by filtration or centrifugation. The filtration can be done with a Niagara-type filtration system that allows micro-filtration applications.

In a next step, water and volatile compounds, i.e. light hydrocarbons, are removed from the used oil, by using atmospheric, flash or molecular distillation.

Upon completion of the prior steps, the oil undergoes extraction with aliphatic organic solvents within certain organic solvents/used oil ratios, and pressure and temperature. The output is, on the one hand, an extract composed of a mixture of oil base and organic solvents. The extract is let remain to rest in a tank with a conic bottom, within specific timeframes. On the other hand, a semi-solid, viscoelastic precipitate containing the used oil pollutants is formed and transferred into another tank and subsequently converted into an asphaltic product. The choice of the organic solvents/used oil ratio, and pressure and temperature depends on the physicochemical characteristics found in the used oil. In that way, in the proposed method, the best organic solvents/used oil ratio is used, which may be less than 10-1 (ten portions of mixture of organic solvents and one portion of used oil), and, more effectively, a 2-1 and 6-1 ratio. On the other hand, a mixture of only two organic solvents is used to extract the oil base for a ratio from 1-1 (1 portion of solvent and 1 portion of another solvent) up to a 3-2 ratio (3 portions of solvent and 2 portions of another solvent) including fractions of these organic solvents. For instance, ratios of 0.75-0.5, 1-0.66, 1.5-1, etc. That is to say, an intermediate relation between the relations 1-1 and 3-2. Two organic solvents are used in the mixture: of aliphatic nature and alcohol type. More specifically, they may be primary and secondary alcohols, of carbonate chain of 3-5 carbons. The temperature where the extraction is carried out, should be lower than 35° C., much rather from 15° C. to 30° C., or, even better, from 20° C. to 28° C. The combination of four factors: (1) the use of only two organic solvents; (2) their mixture ratio; (3) the organic solvents-used oil ratio, and (4) the temperature for the extraction, achieves such a condition that: (I) prevents the formation of micro-emulsions and (II) by letting the extract resulting from the organic solvents-used oil extraction remain at rest immediately after the extraction for a period of time ranging from 2 hours to 15 hours, two distinct phases appear in the extract: one, a highly viscous phase, around 30%, contains a percentage of oil based at 70%-75% with the rest being organic solvents; the second phase is rich in organic solvents, around 70%, containing a percentage of organic solvents of 70%-75%, with oil base as the remainder.

The highly viscous phase, rich in oil base is separated from the other state, rich in organic solvents, by decanting. The oil base present in the highly viscous phase is separated from organic solvents by means of atmospheric, flash or molecular distillation. There, the separated organic solvents are recovered through condensation and stored for further reuse. The phase rich in organic solvents may be either distilled by separating its components or used for another extraction. This time, however, in a ratio different from the ratio mentioned above, which may range from 6-1 to 15-1 (portions of phase rich in organic solvents and 1 portion of used oil). By letting the extract resulting from this new extraction of organic solvents-used oil remain at rest immediately after the extraction for a period of time tantamount to the timeframe taken in the prior extraction, two distinct phases emerge again, with similar characteristics, as compared to the first extraction. The procedure for the separation of these phases is repeated, and each of them follows the same procedure previously described. Therefore, there are energy and time savings compared to when using distillation to separate the admixture of oil base-organic solvents.

The proposed method features the use of a novel, exclusive system consisting of filtration by adsorption with nano-particles of silica dioxide, $SiO_2$. Such nano-particles are, although not exclusively, packed in a filter element that contains them and allows the oil base to pass a precise range of pressure and temperature, letting the no polar chemists pass by and retaining aromatics and resins, metals and organometallics complexes. Also under certain controlled conditions of temperature, pressure and time, the adsorbent can be added in a certain proportion to the oil, to mix them under agitation for a certain time and then pass this mixture through a system filters that can be, but not exclusive, press type, Niagara or similar. This last phase produces high-quality oil base with a very low content of aromatics, free from metals and organometallic complexes, consistently with a Group II base, based on its content of saturated molecules, viscosity index and low content of sulfur.

What is claimed is:

1. A process for recovery and upgrade of an oil base from a used oil, comprising:

classifying the used oil according to its physicochemical characteristics in order to optimize the subsequent phases;

physically pre-treating the used oil to remove solids of about 20 microns or more from the used oil, dehydrating the used oil, and extinguishing in the used oil the remains of light hydrocarbons to obtain pre-treated oil;

extracting the pre-treated oil with only two organic solvents in a specific ratio to obtain an extract and a viscoelastic and semi-solid precipitate;

separating the extract composed of the oil base and the organic solvents from a precipitate by physical methods;

passing the extract through a physical procedure that separates the organic solvents from the oil base by a distillation method selected from the group consisting of atmospheric distillation, flash distillation and molecular distillation;

upgrading the recovered oil base physicochemically; and providing the viscoelastic and semi-solid precipitate with a series of physicochemical processes to oxidize it and upgrade its properties.

2. The process of claim 1, wherein an organic solvent/used oil ratio of less than 10:1 is used.

3. The process of claim 2, wherein a mixture of only two organic solvents is used to extract the oil base, wherein the two organic solvents are used in a ratio of from 1:1 to 3:2 including fractions of the organic solvents.

4. The process of claim 3, wherein the two organic solvents are aliphatic alcohols.

5. The process of claim 1, wherein a temperature where the extraction is carried out is lower than 35° C.

6. The process of claim 1, further comprising letting the extract rest immediately after the extraction for a period of time ranging from 2 hours to 15 hours to obtain a first phase distinct from a second phase, wherein the first phase is a viscous phase comprising about 70%-75% a percentage of oil base and about 25%-30% organic solvents and wherein the second phase comprises about 70%-75% organic solvents and about 25%-30% percentage oil base.

7. The process of claim 6, wherein the first and second phases are separated by decanting, wherein the oil base present in the first phase is separated from organic solvents in the first phase using a method selected from the group consisting of atmospheric distillation, flash distillation and molecular distillation, and wherein the separated organic solvents are recovered through condensation and stored for further reuse.

8. The process of claim 6, wherein the second phase is either distilled by separating its components or used for a subsequent extraction using a ratio of second phase to pre-treated used oil of from 6:1 to 15:1.

9. The process of claim 1, wherein the process is carried out in an apparatus that adsorbs components responsible for darkening of paraffinic, naphthenic and other hydrocarbons containing compounds or polar species, which are desired to be separated.

10. The process of claim 2, wherein the organic solvents/used oil ratio is less than 3:1.

11. The process of claim 10, wherein the organic solvents/used oil ratio is less than 2:1.

12. The process of claim 4, wherein aliphatic alcohols are primary or secondary alcohols having a carbonate chain of 3-5 carbons.

13. The process of claim 5, wherein the temperature is from 15° C. to 30° C.

14. The process of claim 13, wherein the temperature is from 20° C. to 28° C.

15. The process of claim 6, wherein only two organic solvents are used, and wherein a ratio of mixture of the two organic solvents, a ratio of amount of organic solvent to amount of oil and a temperature of extraction are selected such that formation of micro-emulsions is prevented and (II) the two distinct phases appear in the extract.

16. The process of claim 8, further comprising letting the extract obtained from the subsequent extraction rest immediately after the extraction, for a period of time ranging from 2 hours to 15 hours to obtain two distinct phases, in which one of the distinct phases contains more organic solvents than oil base.

17. The process of claim 16, wherein the distinct phases containing more organic solvents than oil base are used in another extraction of oil base.

18. The process of claim 9, wherein the apparatus includes aggregates of nanoporous silica nanoparticles obtained from agricultural waste as an adsorbent, further comprising putting oil base recovered inside the apparatus in contact with the aggregates.

* * * * *